US009415897B2

(12) United States Patent
Corbeil

(10) Patent No.: US 9,415,897 B2
(45) Date of Patent: Aug. 16, 2016

(54) CONTAINER ASSEMBLY

(76) Inventor: Jean Paul Corbeil, Munich (DE)

( * ) Notice: Subject to any disclaimer, the term of this patent is extended or adjusted under 35 U.S.C. 154(b) by 135 days.

(21) Appl. No.: 13/989,762

(22) PCT Filed: Nov. 24, 2011

(86) PCT No.: PCT/EP2011/070962

§ 371 (c)(1),
(2), (4) Date: Jun. 11, 2013

(87) PCT Pub. No.: WO2012/069598

PCT Pub. Date: May 31, 2012

(65) Prior Publication Data

US 2013/0264357 A1 Oct. 10, 2013

(30) Foreign Application Priority Data

Nov. 24, 2010 (DE) ..... 10 2010 052 225

(51) Int. Cl.
*B65D 21/02* (2006.01)
*B65D 1/04* (2006.01)
*B65D 81/32* (2006.01)

(52) U.S. Cl.
CPC *B65D 21/02* (2013.01); *B65D 1/04* (2013.01); *B65D 81/3216* (2013.01)

(58) Field of Classification Search
CPC ..... B65D 1/04; B65D 21/02; B65D 81/3216
USPC ..... 222/129, 143, 94; 220/504, 23.83; 215/6, 10
See application file for complete search history.

(56) References Cited

U.S. PATENT DOCUMENTS

| | | | | | |
|---|---|---|---|---|---|
| 3,327,881 | A * | 6/1967 | Maier | 215/6 | |
| 3,729,114 | A * | 4/1973 | Mari | 220/504 | |
| 3,731,848 | A * | 5/1973 | Nakanishi | 222/129 | |
| 3,856,138 | A * | 12/1974 | Maekawa et al. | 206/221 | |
| 4,573,595 | A * | 3/1986 | Mednis | 215/10 | |
| 5,065,875 | A * | 11/1991 | Balavich | 215/10 | |
| 5,499,738 | A * | 3/1996 | Burleigh | 220/504 | |
| 5,803,268 | A * | 9/1998 | Levy et al. | 206/581 | |
| 6,105,812 | A * | 8/2000 | Riordan | 220/504 | |
| 6,439,416 | B1 * | 8/2002 | Hawkins | 220/524 | |
| 2004/0159625 | A1 * | 8/2004 | Kwon | 215/329 | |
| 2005/0098527 | A1 * | 5/2005 | Yates, III | 215/6 | |
| 2008/0296246 | A1 * | 12/2008 | Chow | B65D 1/04 215/6 | |
| 2015/0344185 | A1 * | 12/2015 | Corbeil | B65D 21/0204 220/4.21 | |

* cited by examiner

*Primary Examiner* — Kevin P Shaver
*Assistant Examiner* — Robert Nicholas, II
(74) *Attorney, Agent, or Firm* — Karl F. Milde, Jr.; Eckert Seamans Cherin & Mellott, LLC

(57) ABSTRACT

The present invention relates to a container assembly having a first container part (2) with a dispensing opening (8), and a second container part (3) with a dispensing opening (9). Thus, the first container part (2) and the second container part (3) can be connected to one another such that the dispensing opening (8) of the first container part (2) points in a first direction and the dispensing opening (9) of the second Container part (3) points in a second direction.

8 Claims, 11 Drawing Sheets

CONTAINER ASSEMBLY

BACKGROUND OF THE INVENTION

From EP 97954995.3 comes what is referred to as a "double container" comprising two container chambers, the contents of which can be dispensed by one and the same opening. The two chambers can be separably connectable to each other, forming a single bottle in the interconnected state. Both container chambers have a common closure that is arranged on one side of the double container.

The object of the present invention is to provide a container assembly that is extremely easy to handle, which can form a unit for two complementary different product components, and which can substantially simplify the storage and dispensing of the product components.

SUMMARY OF THE INVENTION

This object is achieved through a container assembly comprising a first container part having a dispensing opening and a second container part having a dispensing opening. The first container part and second container part are connectable to each other such that the dispensing opening of the first container part points in a first direction and the dispensing opening of the second container part points in a second direction.

The main advantage of the container assembly of the present invention is that it comprises two container parts that are releasably connectable to each other that, when they are attached to each other form a space-saving unit, whereby the one container part from one side and the other container part from the other, opposite side, are accessible. This ensures that when the container assembly is arranged or placed in an upright state, the opening part of one container will point upwards and the opening of the other container part point downwards. This is particularly important and advantageous when the container part with the opening pointing upwards contains a less viscous medium and the other container portion with the opening facing downwards contains a more viscous medium. The more viscous medium thus always automatically flows into the area of the container opening pointing downwards, so that it is always available for dispensing. Particularly advantageous in view of the stability and the flow behavior of media is when the first direction and the second direction are offset by 180° from each other.

In a preferred embodiment of the invention, the dispensing opening of a container portion of the present container assembly is closed by a first cover part. Accordingly, the dispensing opening of the second container part is closable by a second cover part.

Especially advantageous is an embodiment of the present container assembly wherein the first container part has a recess that, starting from the bottom wall opposite the first dispensing opening, extends into the interior of the first container part, whereby the second container part is arranged in the recess. Thereby, the recess is spaced apart from the wall of the first container part along its entire periphery, so that the second container part is completely enclosed by the medium of the first container part. Alternatively it is conceivable that the recess engages closely in a cut-out in the wall of the first container part, so that the portion is visible from the outside. In this manner, for example, a user can recognize a label from the outside of the second container part. If the wall of the second container part and the wall of the first container part are composed of a transparent material at least in the region of said cut-out, a user can advantageously perceive the filling level of the second container part from the outside.

In another embodiment of the container assembly according to the present invention, an opening is arranged in the bottom wall of the first container part such that the wall area arranged in the first container part surrounding the dispensing opening in the second container part extends through the opening in the bottom wall. Here, a sealing of the interior of the first container part can be particularly simple in that said wall part surrounding the edge area of the second container part rests tightly on the bottom wall of the first container part. In this case, said edge area and said bottom wall can be tightly connected to each other by welding or gluing.

Alternatively, an effective and simple sealed connection in the area of the opening in the bottom wall of the first container part can also be effected by the edge of the opening in the bottom wall of the first container part being attached to one of the receiving flange members of the wall area surrounding the dispensing opening of the second container part. In this case, the flange member and the wall area can be tightly connected to each other by welding or gluing.

An excellent stability of the present container assembly on a flat base is achieved when the first closing part that closes the first dispensing opening has a planar surface that is arrangeable on the base such that the container assembly stands upright. Accordingly, the second closing part that closes the second dispensing opening can likewise have such a flat surface. The container assembly can then optionally be placed with either the first dispensing opening or the second intake opening pointing downwards to the base.

Another advantage of the container assembly according to the present invention can be achieved in that the two container parts can be composed of materials of different hardness, preferably plastic materials, so the container part containing a relatively viscous medium is readily compressible for dispensing. If the other container part with the opening pointing upwards is composed of a relatively hard material, it is particularly suitable for the container part that serves as the carrier to be composed of a relatively soft material.

Advantageously, the container assembly according to the present invention is suitable for the storage of various materials, more preferably for cosmetic products. For example, one container part with its opening pointing upwards could contain a shampoo, while a relatively thicker conditioner could be arranged in the other container part with its opening pointing downwards. Besides viscous materials, solid, free-flowing materials such as powdery or granular materials can also be arranged in the container parts. For example, the container parts could contain sugar and salt, or fertilizers kept separate for fertilizing in summer or in winter.

The present container assembly provided with the cover parts is preferably in the form of a cylinder. However, embodiments are also conceivable in which the second container part is arranged in a recess that is not in the bottom wall, but in the wall of the first container part. Here, the second container part can be completely contained within the recess so that it complements the exterior contours of the first container part, or it can also protrude beyond the outer contours of the first container part. It is also conceivable that the second container part is smaller than the recess.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
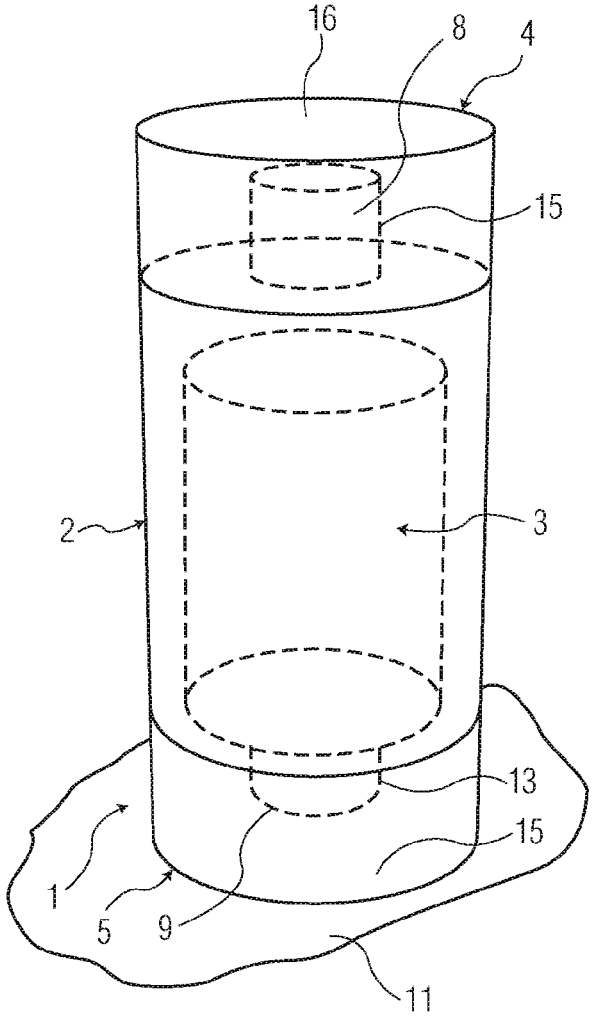
FIG. 1 is a schematic, perspective view of a present container assembly, wherein the two container parts are connected to each other and the downwards pointing container part is shown by broken lines.

According to FIG. 1, the present container assembly 1 is substantially composed of a first container part 2 and a second container part 3. The first container member 2 has a dispensing opening 8, its wall portion being designated by 15 and is closable by a cover part 4. The cover part 4 preferably has the form of a cap securable to the wall portion 15 surrounding the discharge opening 8.

The second container member 3 has a dispensing opening 9, its wall portion being designated by 13 and is closable by a cover part 5. The cover part 5 likewise preferably has the form of a cap securable to the wall portion 13 surrounding the dispensing opening 9. The underside of the cover part 5 preferably has a flat surface 15 that can be set down on a flat surface so that the entire container assembly 1 stands on the base. Accordingly, the cover part 4 can have a flat surface 16 that can be set down on a flat surface.

The first container portion 2 and the second container part 3 are preferably formed in the shape of a bottle, can or cup. Container assembly 1 provided with the cover parts 5, 5 preferably has the general shape of a cylinder, in particular a circular cylinder. However, other shapes are also conceivable.

Figure 2:
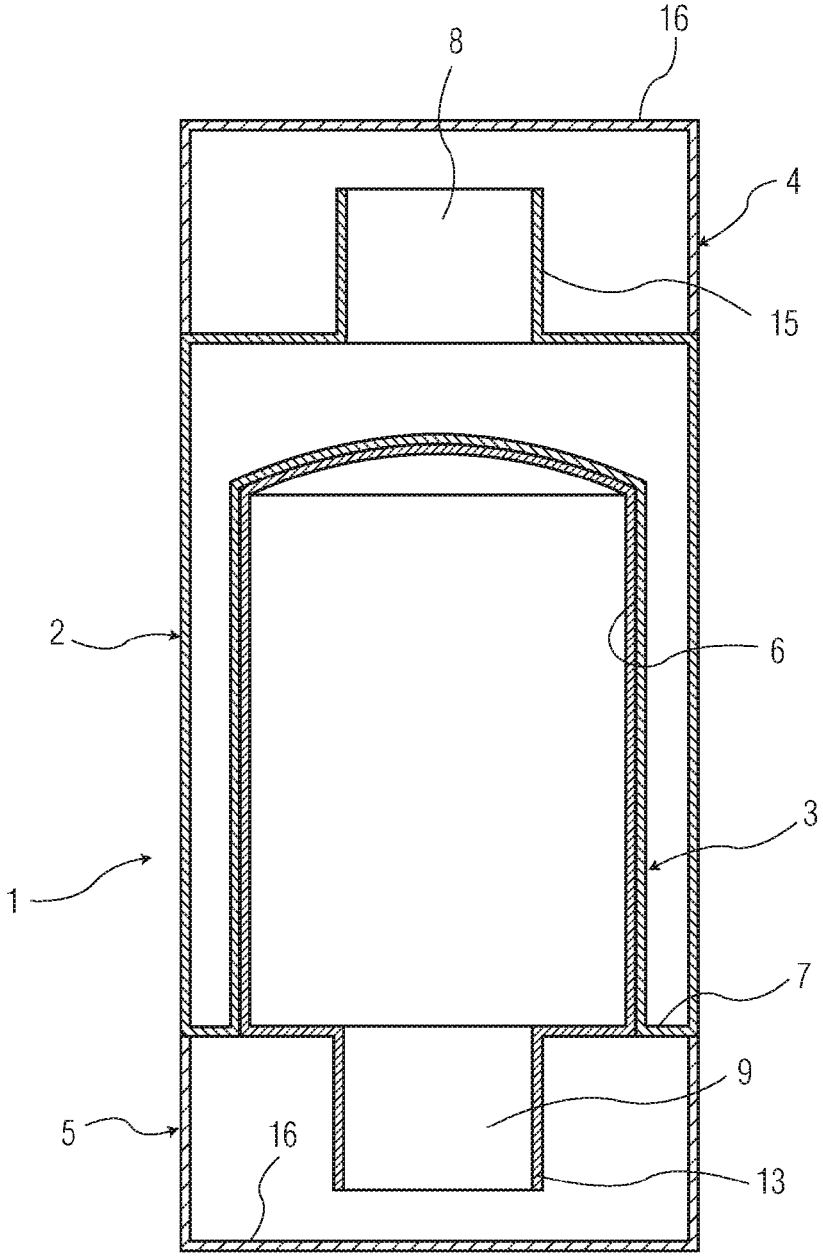
FIG. 2 is a first embodiment of the container assembly according to the present invention, shown in cross-section.

In the manner obvious from FIG. 2, the first container part according to a first embodiment of the present container assembly 1 has a open recess 6 facing downwards through the bottom wall 7 of the first container part 2, in which the second container part 3 is arranged such that its dispensing opening 9 faces downwards. The recess 6 and the second container part 3 are formed to be suitably complementary to one another.

Figure 3:
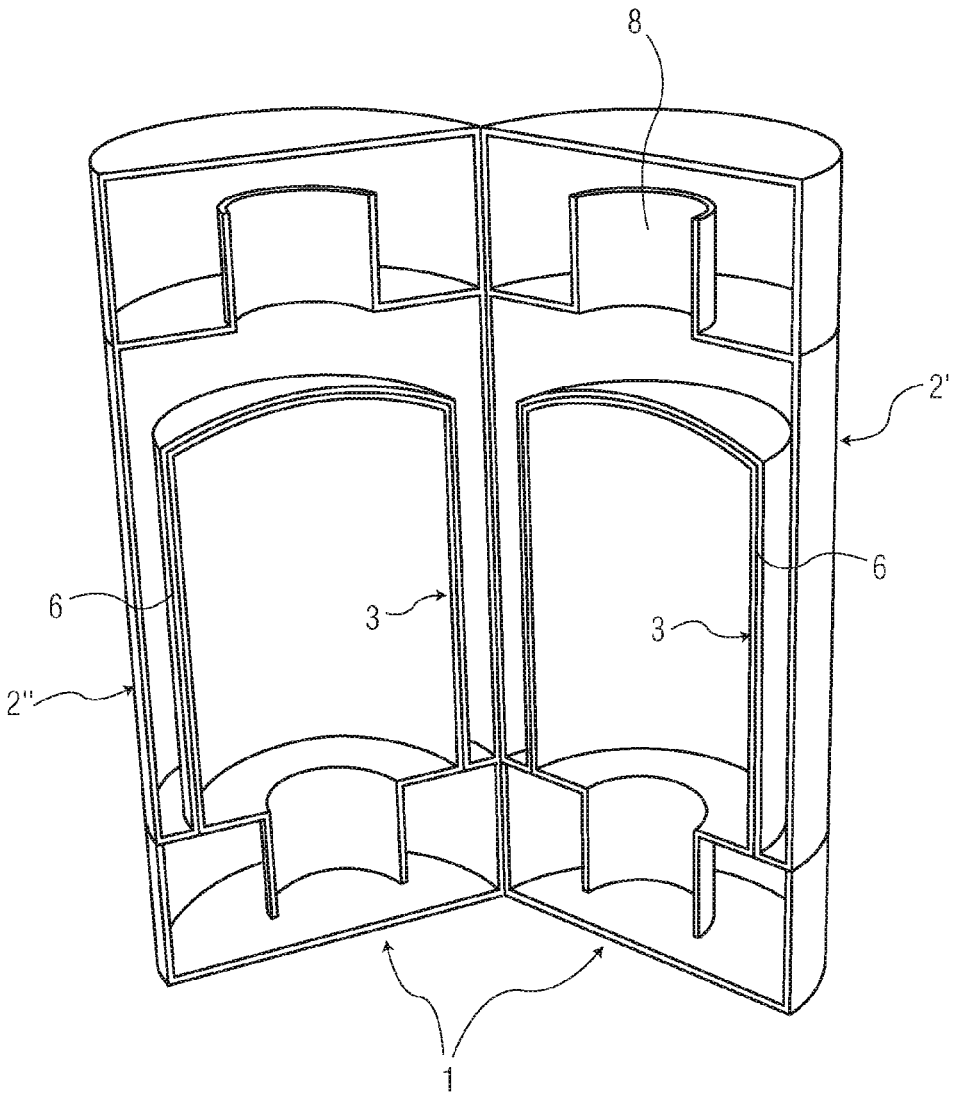
FIGS. 3 and 4 are different views of the container assembly of FIG. 2, wherein an outer container part has an internal recess for receiving an inner container part.
Figure 4:
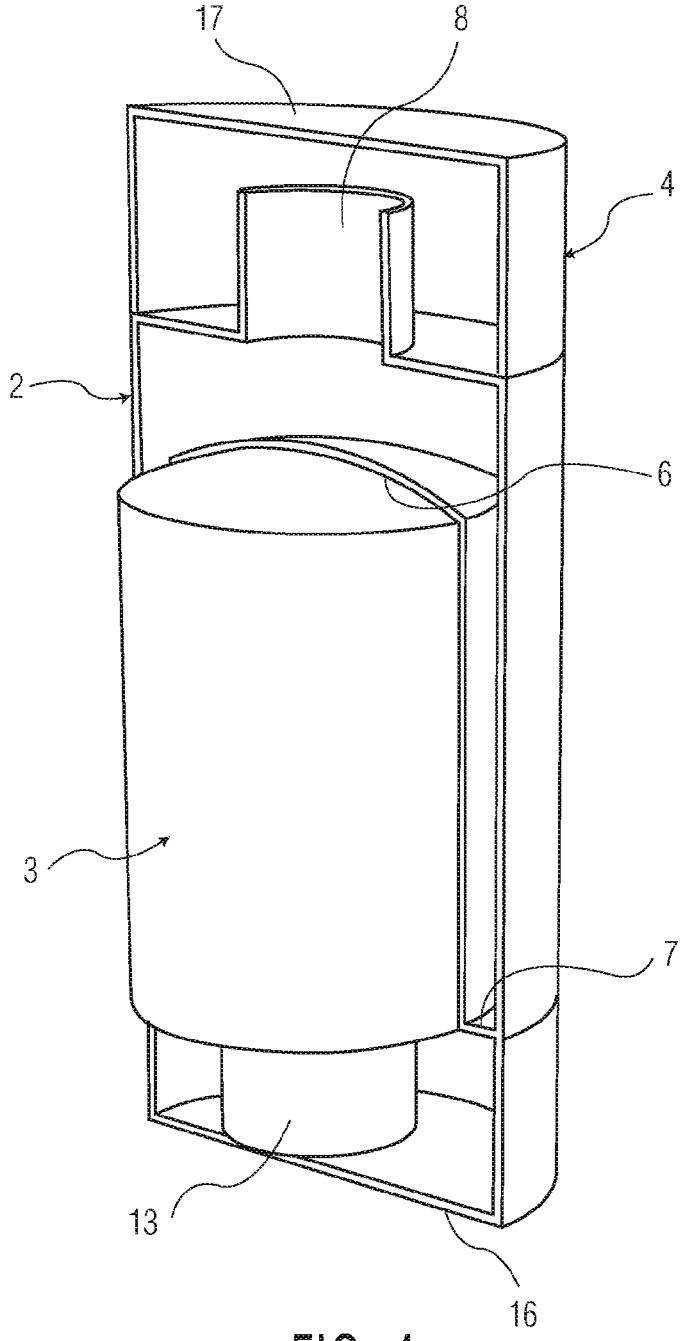

FIG. 3 shows a cross-sectional view of the first container portion 2 and the second container part 3, while FIG. 4 shows a view in which the second container part 3 is shown in its entirety. Container parts 2 and 3 are two components independent from each other. The second container member 3 is preferably secured to the inner wall of the recess 6 preferably by gluing or welding such that its dispensing opening 9 projects downwards over the bottom wall 7.

The first container portion 2 according to FIG. 3 is suitably composed of two preferably identical parts 2' and 2", which after securing the second container member 3 in the portion of recess 6 arranged in 2' are tightly secured to each other, preferably by welding.

The dispensing of the medium of the first container portion 2 takes place if the first dispensing opening 8 is opened and the second dispensing opening 9 is closed, such that a pressure is exerted on the wall of the first container part 2. The dispensing of the medium of the second container part 3 takes place if the first dispensing opening 9 is opened and the second dispensing opening 8 is closed, such that a pressure is exerted on the wall of the first container part 2 and this pressure simultaneously acts upon the wall of the second container part.

Figure 5:
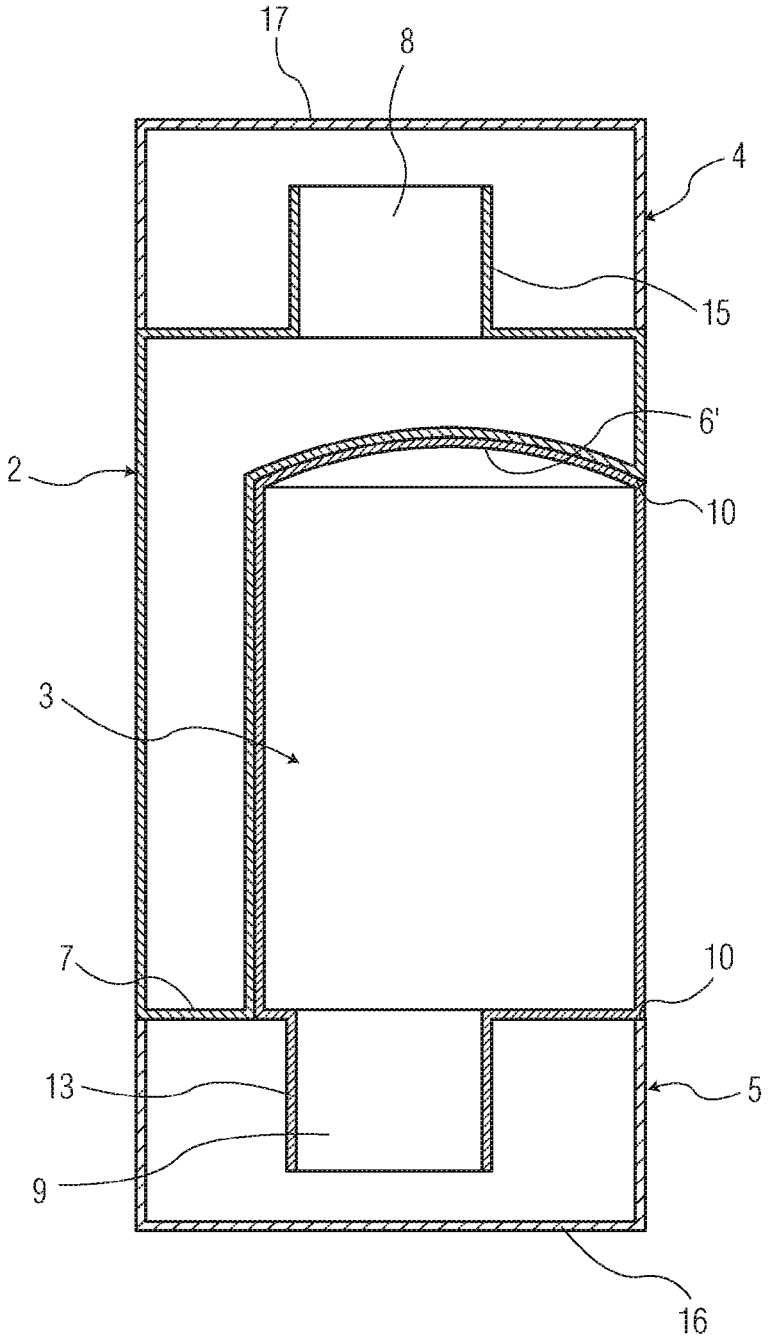
FIG. 5 is a second embodiment of the container assembly according to the present invention, shown in cross-section.
Figure 6:
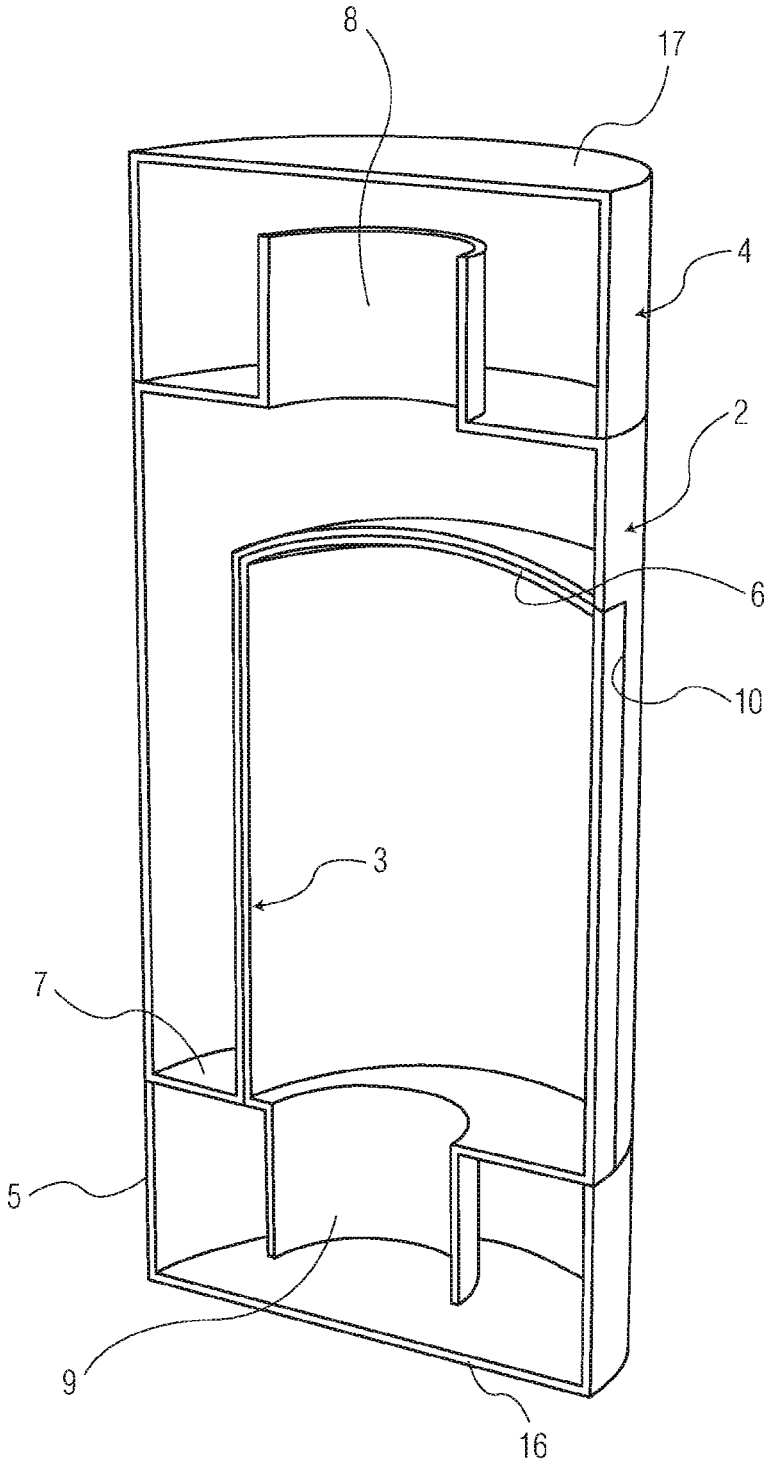
FIGS. 6 and 7 are different views of the container assembly of FIG. 5 in which an outer container part has a recess for receiving an inner container part in such a way that a portion of the inner container part is visible from the outside through a cut-out of the wall of the outer container part.
Figure 7:
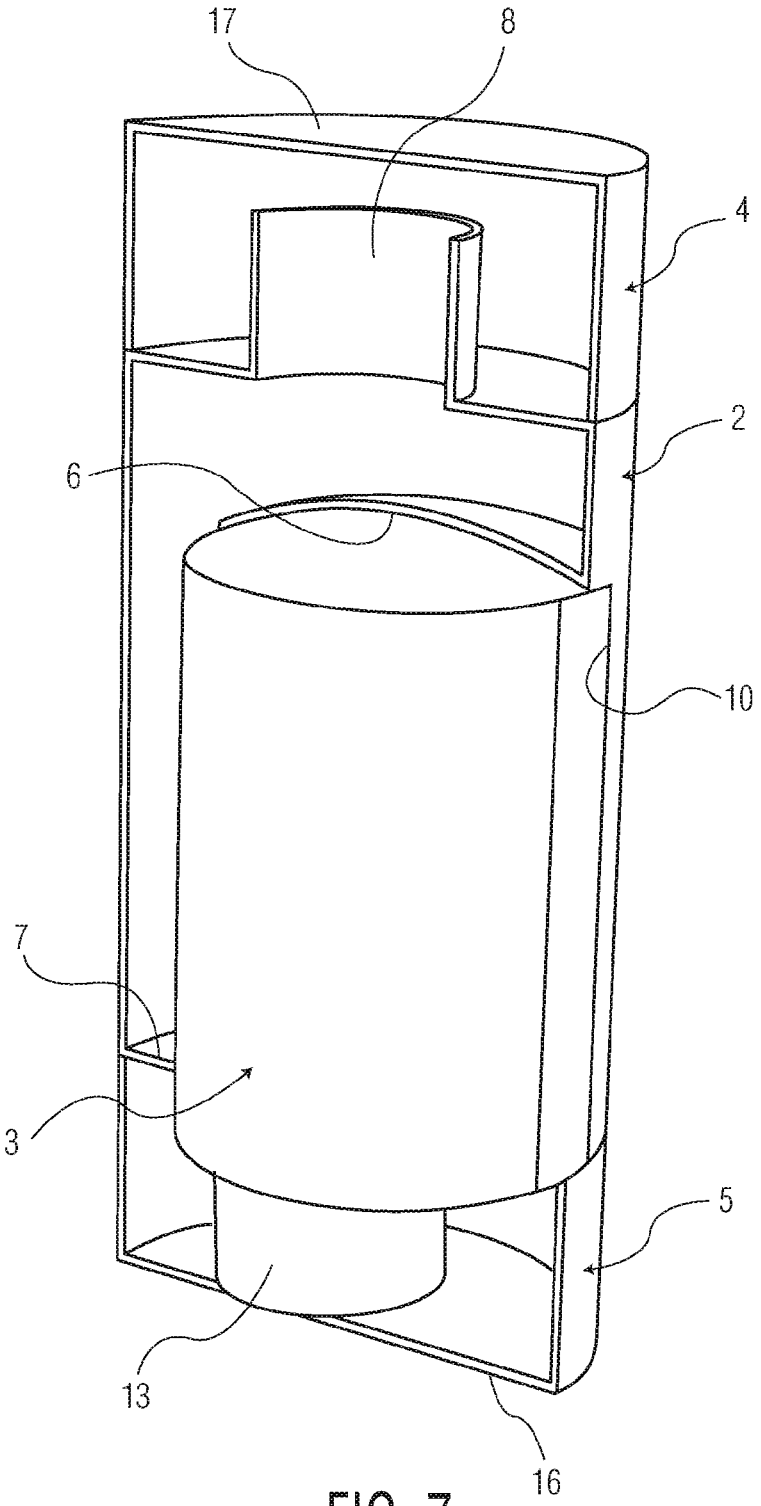

FIGS. 5 to 7 show a second embodiment of the container assembly 1 of the present invention which is similar to the first embodiment, but in contrast to FIGS. 2 to 4, the recess 6' in the first container part 2 is formed such that it opens to the outside laterally in a window or cut-out 10 in the wall of the first container part 2, so that a portion of the wall of the second container part 3 is visible from the outside. This has the advantage that through the cut-out 10, for example, a label can be visible from the outside of container part 3, or the filling level in the second container part 3 can be perceived if this has a transparent wall. Details of the FIGS. 5 to 7 that have been already explained in connection with FIGS. 2 to 4 are indicated accordingly.

Figure 8:
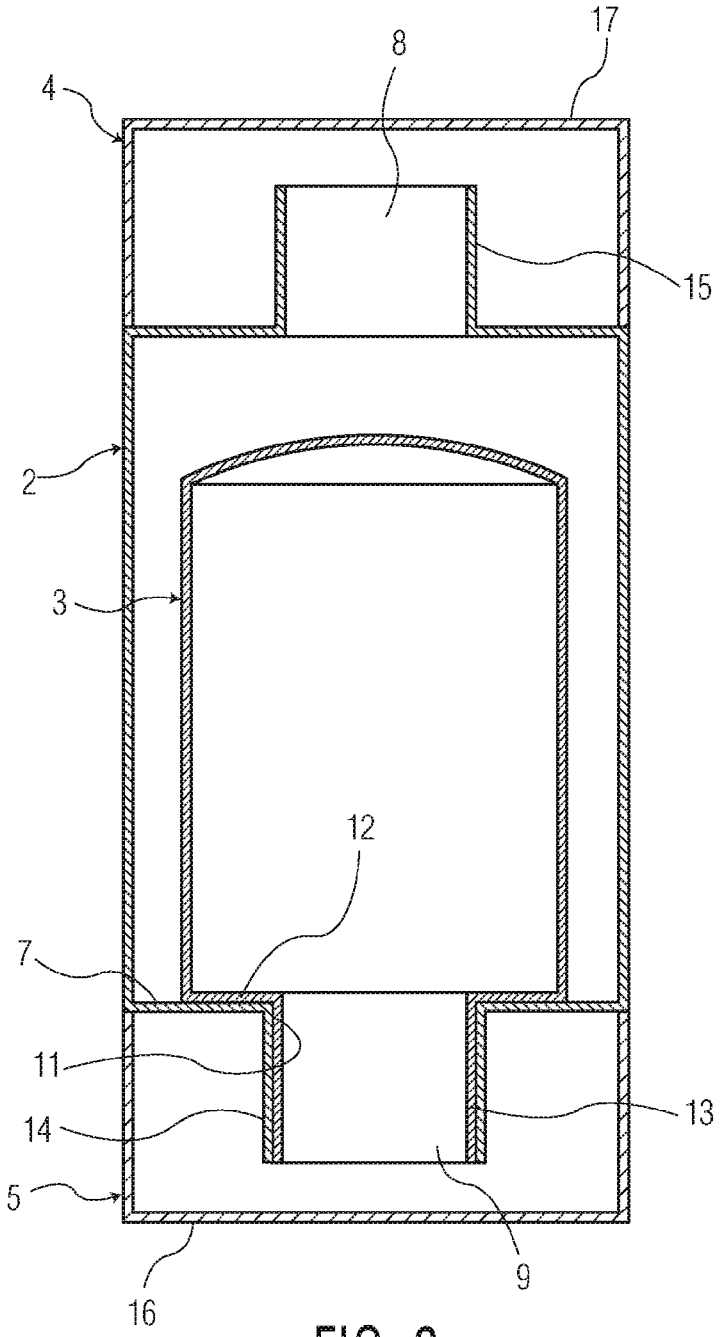
FIG. 8 is a third embodiment of the container assembly according to the present invention, shown in cross-section.
Figure 9:
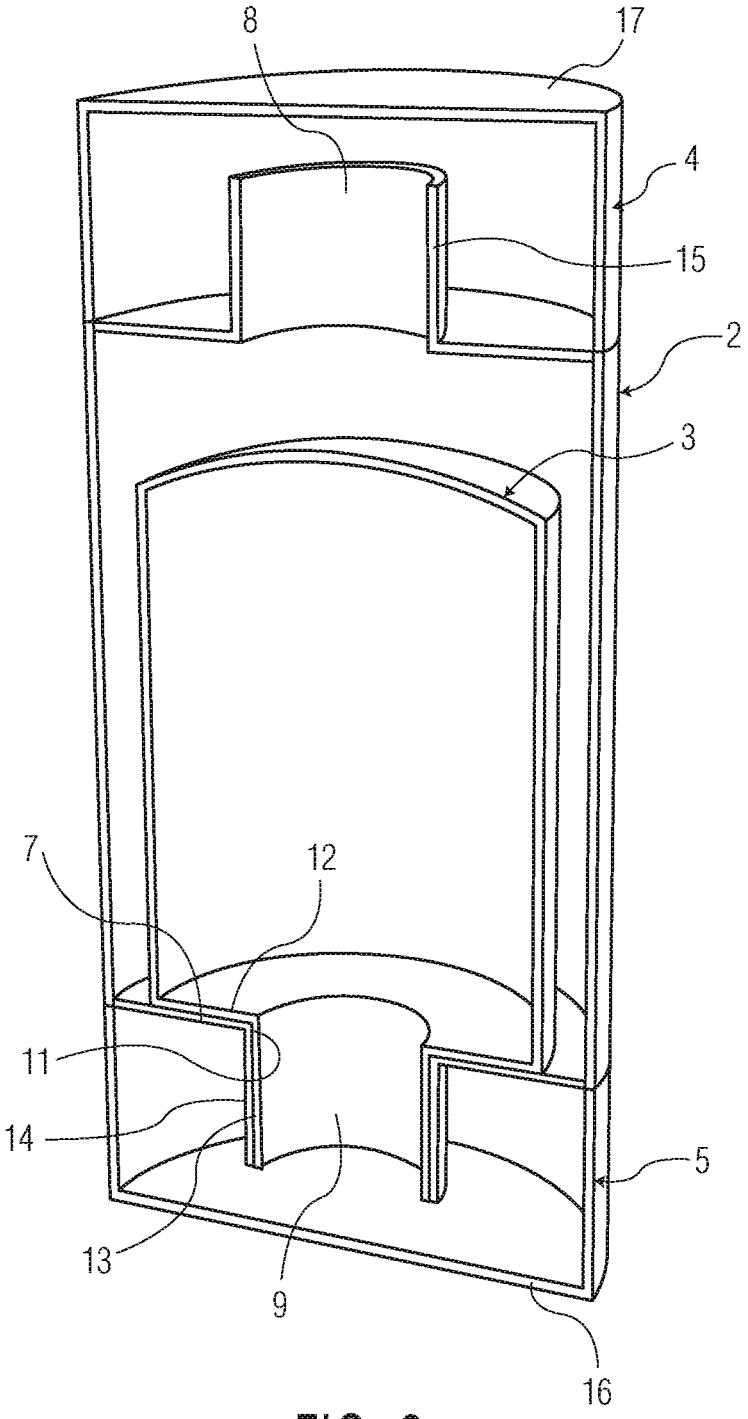
FIGS. 9 and 10 are different views of the container assembly of FIG. 8, wherein an inner container part is arranged directly in the outer container part.
Figure 10:
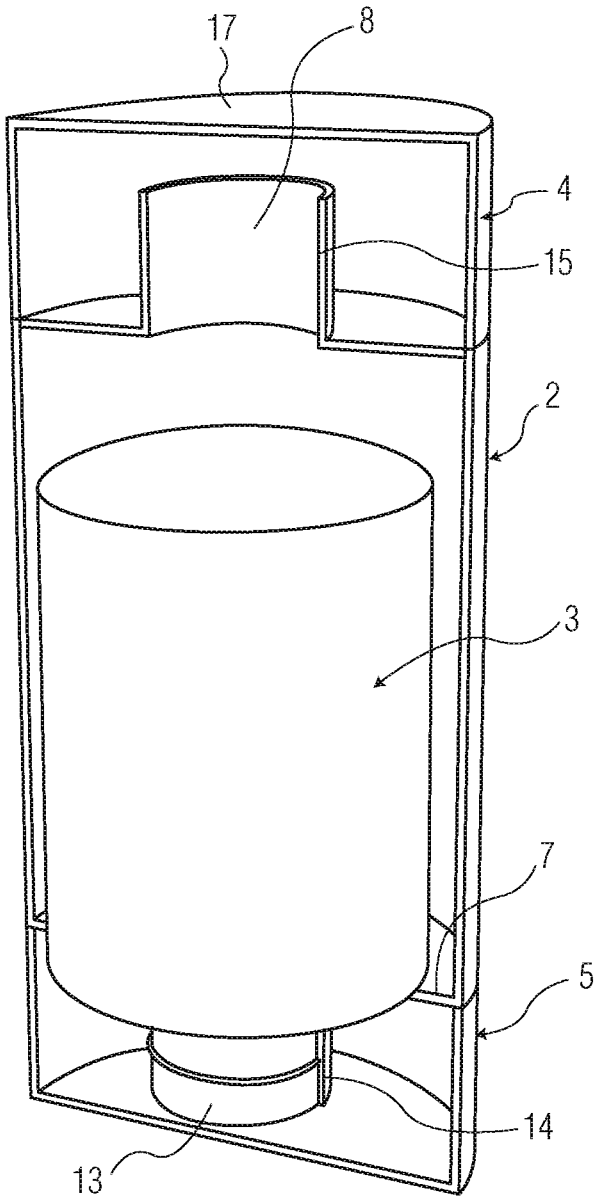

While in the embodiment of FIGS. 2-7, the second container part 3 is arranged in a recess 6 or 6' of the first container part 2, it is also possible according to FIGS. 8 to 10 that the second container part 3 is arranged directly in the first container part 2 such that only the wall area 13 of its dispensing opening 9 tightly protrudes through a sealed opening 11 that is located in the bottom wall 7 of the first container part 2. In this case it is advantageous if of edge area 12 surrounding the wall area 13 of the dispensing opening 9 of the second container part 3 is supported at the bottom wall 7 of the first container part. Details of the FIGS. 8 to 10 that have been already explained in connection with FIGS. 2 to 7 are indicated accordingly. To establish a seal between the wall part 13 and the bottom wall 7 in a simple manner, the first container part 2 can have a flange member 14 that surrounds the opening 11 and faces downward. The wall area 13 of the dispensing opening 9 can then engage with the flange member 14 and be tightly connected therewith by welding or gluing. The cover part 5 is in this case attachable to the flange member 14.

An essential feature of the present invention is that the second container part 3 is arranged in the first container part 2 so that when the container assembly 1 according to FIG. 1 is arranged to stand upright on a base U, its cover part 5 is below, while the cover part 4 of the container part is located above of under these conditions. This ensures that in said orientation of the container assembly 1, the container part 3 faces down such that the preferably viscous medium contained therein always flows to the side facing the cover part 5. However, it is also conceivable for the embodiments described that the relatively viscous medium is arranged in the first container part 2. In this case, the container assembly with the cover part 4 is set down on the base U.

In use, the container assembly 1 is taken up in the hand, and depending on the requirements, the upper cover part 4 is opened for dispensing a preferably lower viscosity medium from the container part 2, or the cover part 5 is opened for dispensing a preferably more viscous medium from the container part 3.

Figure 11:
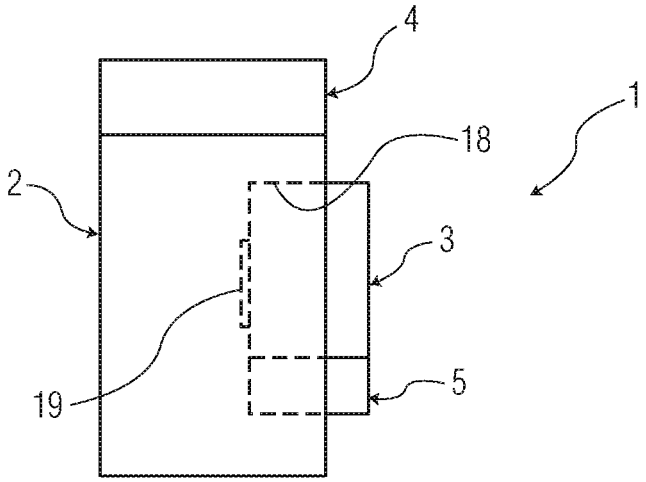
FIG. 11 is a schematic view of further improvement of the present invention.

According to FIG. 11, the container part 3 can be arranged in a recess 18, which is located laterally in the wall of the container part 2. Details of FIG. 11 that have been already explained in connection with FIGS. 1 through 10 are indicated accordingly. The container part 3 can be releasably secured in the recess 18 with the help of a locking device 19, not shown in detail. In this case, the container part 3 can be formed such that it complements the outer contours of the container part 2. Alternatively, the container part 3, as shown can protrude over the recess 18 to the outside. It can also be smaller than the recess 18.

There has thus been shown and described a novel container assembly which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to covered by the invention, which is to be limited only by the claims which follow.

The invention claimed is:

1. A container assembly comprising a first container part having a dispensing opening, and a second container part having a dispensing opening, wherein the first container part and the second container part can be connected to one another such that the dispensing opening of the first container part points in a first direction and the dispensing opening of the second container part points in a second direction, wherein the first container part has a recess that, starting from a bottom wall of the first container part opposite the first dispensing opening, extends into the interior of the first container part, whereby the second container part is arranged in, and completely encompassed within, the recess, and wherein a portion of the recess opens in a lateral cut-out in a side wall of the first container part, so that a portion of a wall of the second container part is visible from the outside.

2. The container assembly according to claim 1, wherein the first direction and the second direction are offset by 180 degrees with respect to one another.

3. The container assembly according to claim 1, wherein the dispensing opening of the first container part is closable by means of a first cover part and the dispensing opening of the second container part is closable by means of a second cover part.

4. The container assembly according to claim 3, wherein the first cover part has a flat surface, which when the first cover part closes the first dispensing opening is arrangeable on a base (U) such that the container assembly stands upright, whereby the first dispensing opening faces the base (U).

5. The container assembly according to claim 3, wherein the second cover part has a flat surface, which when the second cover part closes the second dispensing opening is arrangeable on a base (U) such that the container assembly stands upright, whereby the second dispensing opening faces the base (U).

6. The container assembly according to claim 3, wherein walls of the first container part and the second container part differ in at least one of hardness and stiffness between said first and second container parts.

7. The container assembly according to claim 1, wherein the recess is spaced apart from the wall of the first container part along its entire periphery.

8. A method of using the container assembly according claim 1, for storage of media having different viscosities in the first container part and in the second container part, comprising the step of inserting liquids of different viscosities in said first and second container parts.

* * * * *